United States Patent [19]

Fisher

[11] Patent Number: 5,057,853

[45] Date of Patent: Oct. 15, 1991

[54] THERMAL INK JET PRINTHEAD WITH STEPPED NOZZLE FACE AND METHOD OF FABRICATION THEREFOR

[75] Inventor: Almon P. Fisher, Rochester, N.Y.

[73] Assignee: Xerox Corporation, Stamford, Conn.

[21] Appl. No.: 577,244

[22] Filed: Sep. 4, 1990

[51] Int. Cl.[5] ..... B41J 2/05

[52] U.S. Cl. ..... 346/140 R; 156/645; 29/890.1; 346/1.1

[58] Field of Search ..... 346/1.1, 140; 156/633, 156/645, 250, 510; 29/890.1

[56] References Cited

U.S. PATENT DOCUMENTS

| | | | |
|---|---|---|---|
| 4,532,572 | 1/1988 | Hawkins et al. | 156/626 |
| 4,638,337 | 1/1987 | Torpey et al. | 346/140 |
| 4,774,530 | 9/1988 | Hawkins | 346/140 |
| 4,878,992 | 11/1989 | Campanelli | 156/633 |

*Primary Examiner*—Joseph W. Hartary
*Attorney, Agent, or Firm*—Robert A. Chittum

[57] ABSTRACT

A thermal ink jet printhead and method of batch production thereof is disclosed. Each printhead has a plurality of nozzles in a stepped nozzle face that are obtained by a two step dicing operation. The printheads being formed by aligning and bonding an anisotropically etched silicon wafer containing a plurality of sets of channel grooves to a silicon wafer containing a plurality of linear arrays of heating elements and addressing electrodes over which a thick film layer is deposited and photopatterned to expose the heating elements and electrode terminals and to remove the areas parallel to and a predetermined distanace from the heating element arrays, thus photodelineating the portion of the thick film layer between the heating elements and the nozzles. The mated wafer sandwiches the thick film layer, and first dicing cutting severs the etch wafer and notches the wafer with the heating elements, forming a nozzle face containing the nozzle. The first dicing cut is made at a location where the thick film layer has been etch removed, thus eliminating the need to dice it, thereby preventing the formation of burrs which affect droplet directionality.

10 Claims, 5 Drawing Sheets

THERMAL INK JET PRINTHEAD WITH STEPPED NOZZLE FACE AND METHOD OF FABRICATION THEREFOR

BACKGROUND OF THE INVENTION

1. Field of the Invention

This invention relates to a thermal ink jet printhead design and method of manufacture and, more particularly, to an improved method of fabricating a thermal ink jet printhead by dicing the nozzle face after photodelineating the thick film layer in the ink channels downstream from the heating elements to form a printhead with a stepped nozzle face that allows more effective cleaning and improved droplet directionality.

A concurrently filed application, U.S. Ser. No. 07/577,245, filed Sept. 4, 1990, by the same inventor and assignee entitled "Thermal Ink Jet Printhead with Pre-Diced Nozzle Face and Method of Fabrication Therefor" discloses a related invention.

2. Description of the Prior Art

Thermal ink jet printing, though capable of continuous stream operation, is generally a type of drop-on-demand ink jet systems, wherein an ink jet printhead expels ink droplets on demand by the selective application of a current pulse to a thermal energy generator, usually a resistor, located in capillary-filled, parallel ink channels a predetermined distance upstream from the channel nozzles or orifices. The channel end opposite the nozzles are in communication with a small ink reservoir to which a larger external ink supply is connected.

U.S. Pat. No. Re. 32,572 to Hawkins et al discloses a thermal ink jet printhead and several fabricating processes therefor. Each printhead is composed of two parts aligned and bonded together. One part is a substantially flat substrate which contains on the surface thereof a linear array of heating elements and addressing electrodes, and the second part is a substrate having at least one recess anisotropically etched therein to serve as an ink supply manifold when the two parts are bonded together. A linear array of parallel grooves are also formed in the second part, so that one end of the grooves communicate with the manifold recess and the other ends are open for use as ink droplet expelling nozzles. Many printheads can be made simultaneously by producing a plurality of sets of heating element arrays with their addressing electrodes on a silicon wafer and by placing alignment marks thereon at predetermined locations. A corresponding plurality of sets of channel grooves and associated manifolds are produced in a second silicon wafer. In one embodiment, alignment openings are etched in the second silicon wafer at predetermined locations. The two wafers are aligned via the alignment openings and alignment marks, then bonded together and diced into many separate printheads.

U.S. Pat. No. 4,638,337 to Torpey et al discloses an improved thermal ink jet printhead similar to that of Hawkins et al, but has each of its heating elements located in a recess. The recess walls containing the heating elements prevent the lateral movement of the bubbles through the nozzle and therefore the sudden release of vaporized ink to the atmosphere, known as blow-out, which causes ingestion of air and interrupts the printhead operation whenever this event occurs. In this patent, a thick film organic structure such as Riston® or Vacrel® is interposed between the heater plate and the channel plate. The purpose of this layer is to have recesses formed therein directly above the heating elements to contain the bubble which is formed over the heating elements, thus enabling an increase in the droplet velocity without the occurrence of vapor blow-out and concomitant air ingestion.

U.S. Pat. No. 4,774,530 to Hawkins discloses an improvement over the above-mentioned patent to Torpey et al. Recesses are also patterned in the thick film layer to provide a flow path for the ink from the manifold to the channels by enabling the ink to flow around the closed ends of the channels, thereby eliminating the fabrication steps required to open the groove closed ends to the manifold recess, so that the printed fabrication process is simplified.

U.S. Pat. No. 4,878,992 to Campanelli discloses an ink jet printhead fabrication process wherein a plurality of printheads are produced from two mated substrates by two dicing operations. One dicing operation produces the nozzle face for each of a plurality of printheads and optionally produces the nozzles. This dicing blade, together with specific operating parameters, prevent the nozzles from chipping and the nozzle faces from scratches and abrasions. A second dicing operation with a standard dicing blade severs the mated substrates into separate printheads. The dicing operation which produces the nozzle face is preferably conducted in a two-step operation. A first cut makes the nozzle face, but does not sever the two mated substrates. A second dicing cut severs the two substrates, but does so in a manner that prevents contact by the dicing blade with the nozzle face.

In the above patents and in other prior art fabrication methods, the nozzle face of the printheads were made by either a separately fabricated nozzle plate which contains the nozzles and is bonded to the printheads, photolithographically produced from laminated layers, or dicing operation in which aligned and bonded channel plates and heating element plates having a patterned thick film layer sandwiched therebetween are concurrently cut. Unfortunately, in the latter method, the thick film layer cannot consistently be cut in a reliable way. Sometimes a burr is left which causes misdirection of an ejected droplet and, thus poor image quality. In addition, the dicing blade is considerably worn when it cuts non-silicon material, such as, when sectioning the heating element and channel wafers and sandwiched intermediate thick film layer as taught by U.S. Pat. No. 4,878,992.

The invention overcomes the disadvantages of the prior art fabrication methods, eliminating a host of defects which affect dicing yield, and reduces dicing blade wear by orders of magnitude.

SUMMARY OF THE INVENTION

It is an object of the present invention to increase the printhead fabrication yield in a cost effective manner.

It is another object of the invention to provide a printhead having a stepped nozzle face formed by dicing without having to cut a thick film layer which tends to produce burrs.

In the present invention, a plurality of thermal ink jet printheads having stepped nozzle faces are obtained from aligned, mated, and bonded upper and lower substrates. Prior to mating, an upper substrate surface is patterned and anisotropically etched to produce a plurality of sets of parallel channel grooves having closed ends and an associated manifold recess adjacent one end of each set of grooves. The manifold recess is etched through the upper substrate to provide an open bottom.

The lower substrate has a plurality of heating element arrays and addressing electrodes formed on one surface thereof and a thick film layer of insulative polymeric material, such as polyimide, deposited thereon over the heating elements and electrodes. The thick film layer is photodelineated to enable etch removal of specific patterns of the thick film layer to expose the heating elements and, in one embodiment, to provide a trough for use as an ink flow path from the manifold recess to the associated channel grooves, while concurrently producing a slot in the thick film layer parallel to the heating element array. The slot is a predetermined distance from the heating elements and defines the distance of the nozzles from the heating elements. When the substrates are mated and bonded together, the edge of the slot in the thick film layer will serve as the bottom portion of the nozzles with the groove open ends serving as the remainder of the nozzles.

In this embodiment, the plurality of printheads are sectioned into individual printheads by a two step dicing operation, in which one dicing cut is made through both substrates to open the closed ends of the channel grooves in the upper substrate, forming the nozzles in a nozzle face, and to form a notch in the lower substrate parallel, but adjacent the wall of the slot in the thick film layer nearer the heating elements so that the second dicing cut may sever the substrates into a plurality of printheads. The second dicing cut is spaced from the walls of the first dicing cut to prevent damaging contact with the nozzle face and burr producing contact with the thick film layer. This two step dicing operation produces a stepped nozzle face, but the step is well below the nozzles, so that ink collection thereon will not affect ejected droplet directionality. Such a configuration enables dicing without having to cut through the thick film layer or the bonding material, thus increasing the dicing blade lifetime by more than an order of magnitude. Since the thick film layer tends to produce burrs when diced that affect droplet directionality, the removal of the need to dice the thick film layer increases the yield of suitable printheads to near 100%.

Other embodiments of the printhead with a stepped nozzle face include additional dicing steps, so that the portion of the nozzle face containing the nozzles are slightly raised for enabling closer placement of the printhead to the recording medium, while retaining all of the other advantages.

A more complete understanding of the present invention can be obtained by considering the following detailed description in conjunction with the accompanying drawings, wherein like parts have like index numerals.

DESCRIPTION OF THE PREFERRED EMBODIMENT

As disclosed in the prior art discussed above and shown in FIG. 1, thermal ink jet die or printheads 10 are generated in batches by aligning and adhesively bonding an anisotropically etched channel wafer 12 to the heater wafer 14 followed by a dicing sectioning step to separate the individual die. Although a single dicing cut could sever both the channel and heater wafers, U.S. Pat. No. 4,878,992 teaches the use of one dicing cut which severs the channel wafer, but only partially cuts through the heater wafer bonded thereto. A second, coarse, lower cost metal blade finishes the task because the adhesive used to hold the heater wafer in the dicing frame causes extra wear on a high-tolerance, resinoid dicing blade necessary to open the channel groove and concurrently form the nozzles and nozzle face.

Figure 1:
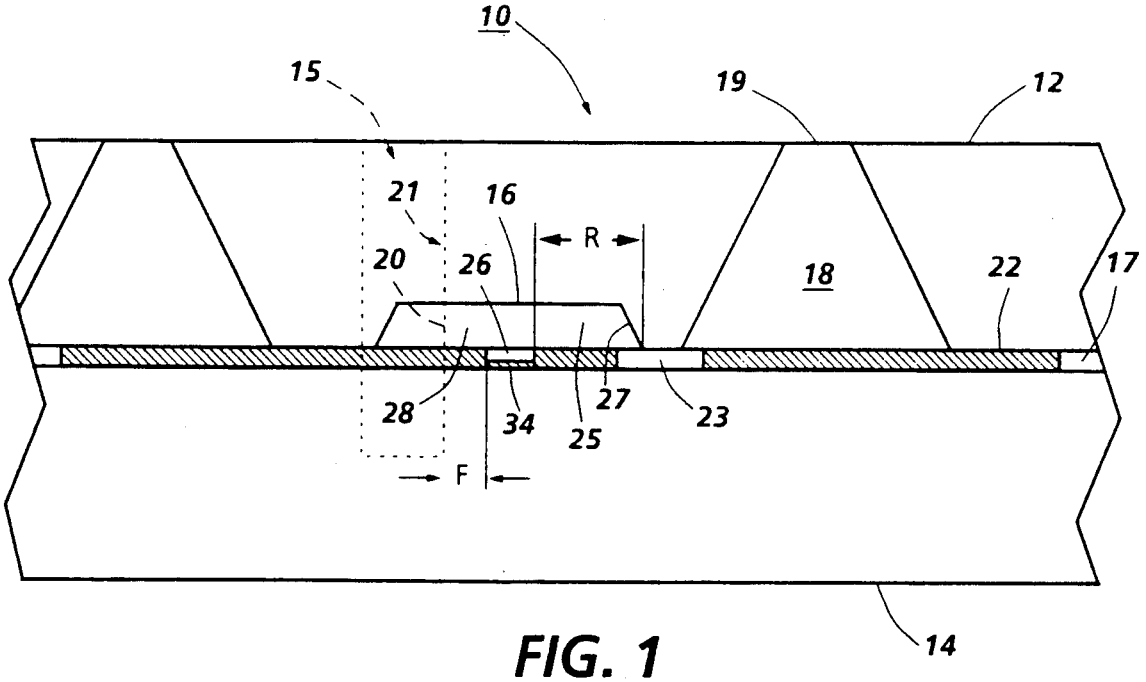
FIG. 1 (Prior Art)
FIG. 1 is a cross-sectional view of a portion of aligned and adhesively bonded channel wafer and heating element wafer prior to separation into a plurality of individual thermal ink jet printheads by dicing according to the prior art.

This first nozzle and nozzle face producing kerf 15 is shown in dashed line; the final sectioning cut through kerf 15 is not shown. U.S. Pat. No. 4,774,530 and FIG. 1, showing processed, mated wafers in a cross sectional view, disclose anisotropically etching a plurality of sets of elongated, parallel channel grooves 16 closed at both ends, and a through etched recess 18 with an open bottom 19 which subsequently serve as ink reservoir and ink inlet respectively. The heater wafer has a plurality of linear arrays of heating elements 34 and associated addressing electrodes (not shown) formed on one surface 17 thereof. A thick film insulative layer 22 of a photopatternable material, such as, for example, polyimide is deposited on the heater wafer surface 17 and over the heating elements and addressing electrodes. This thick film layer is patterned to expose the heating elements, thereby placing the heating elements in separate pits 26, to remove the thick film layer from the electrode terminals (not shown), and to remove the thick film layer at a location which will subsequently provide an ink flow passageway 23 between the reservoir and the channels. The etched channel wafer and heater wafer containing the heating elements arrays, addressing electrodes, and patterned thick film layer are aligned and bonded together, so that the thick film layer is sandwiched therebetween and each channel groove 16 has a heating element 34 therein. These bonded wafers are separated into a plurality of individual die or printheads by a dicing operation that includes placing the bonded wafers in a dicing frame (not shown), which removably holds them, while a high tolerance dicing machine with a resinoid blade, as disclosed in U.S. Pat.

No. 4,878,992, forms kerf 15 and a subsequent dicing cut (not shown) severs bonded wafers into printheads 10. Kerf 15 opens the closed ends of the channel groove 16 opposite the ones adjacent the through recess 18 producing nozzle face 21 and nozzles 20 therein.

Figure 2:
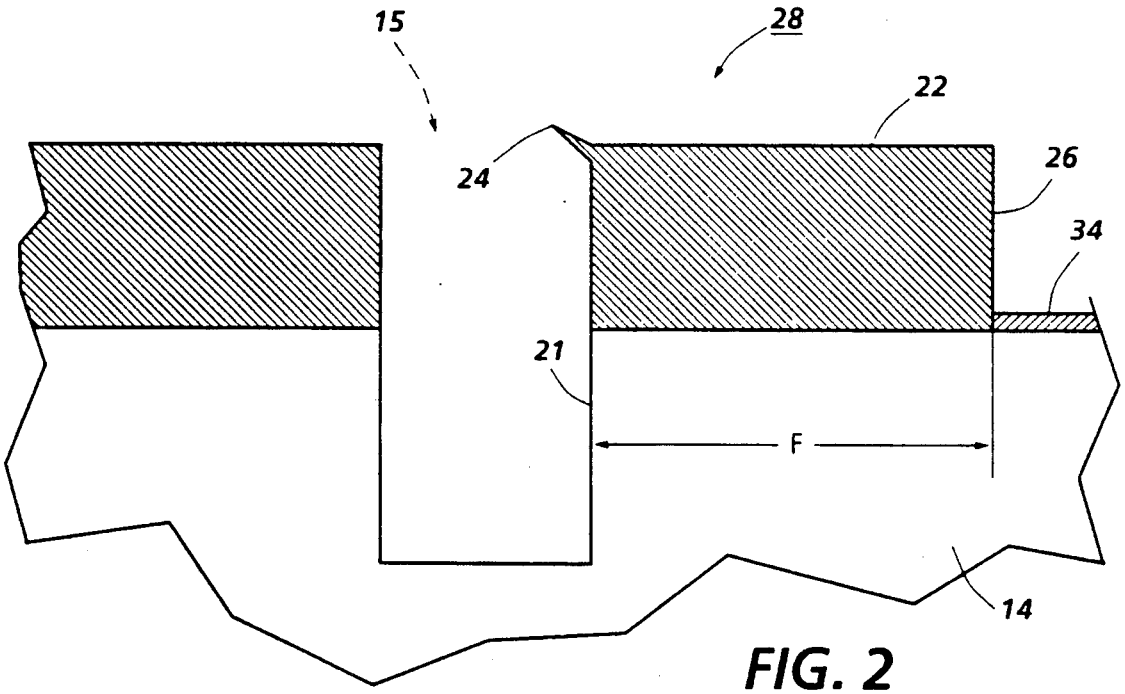
FIG. 2 (Prior Art)
FIG. 2 is an enlarged cross-sectional view of the portion of the printhead of FIG. 1 showing the effect of dicing on the thick film layer between the channel and heating element wafers.

Although U.S. Pat. No. 4,878,992 offered a much improved and cost effective fabricating process with the special resinoid dicing blade, thick film burrs 24 tended to be formed which reduced the yield of printheads as shown in FIG. 2. FIG. 2 is an enlarged cross-sectional view of the thick film layer at the nozzle face 21 produced by the prior art dicing technique of FIG. 1, showing a concurrent dicing cut through the channel wafer, thick film layer, and partially through the heater wafer, after the two wafers were aligned and bonded together. The dicing cut that produced the nozzle face 21 in FIG. 2 is also shown in dashed line.

Referring to FIG. 1, the length of the rear channel portion 25 of the thermal ink jet die (i.e., the distance "R" from the heating element 34 to the through recess reservoir 18) is determined by the placement of the rear closed ends 27 of the channels 16 during the aligning and bonding step. However, the front channel length "F" from the heating element to the nozzle 20 is determined by the placement of the dicing blade during nozzle dicing of the front of the channels which produces the nozzle face 21. This process enables one to set the front channel length to any desired value without changing the photo mask. The main disadvantage of this procedure is that the thick film layer of, for example, polyimide can not be cut cleanly in a reliable way. When the polyimide is not cut cleanly, a 2 micron ragged burr 24 is left in the polyimide, as shown in FIG. 2, that forms the base side of the nozzle, which in this case is triangular in shape. The polyimide burr 24 causes misdirection of a thermal ink jet droplet which results in an image defect. Also, the polyimide causes the dicing blade to wear 50 times faster than silicon, causing blade life to be dependent on the polyimide alone. The polyimide also causes the dicing blade to wear unevenly thus requiring frequent dressing of the blade. Frequent dressing will shorten blade life by many wafers.

Figure 3:
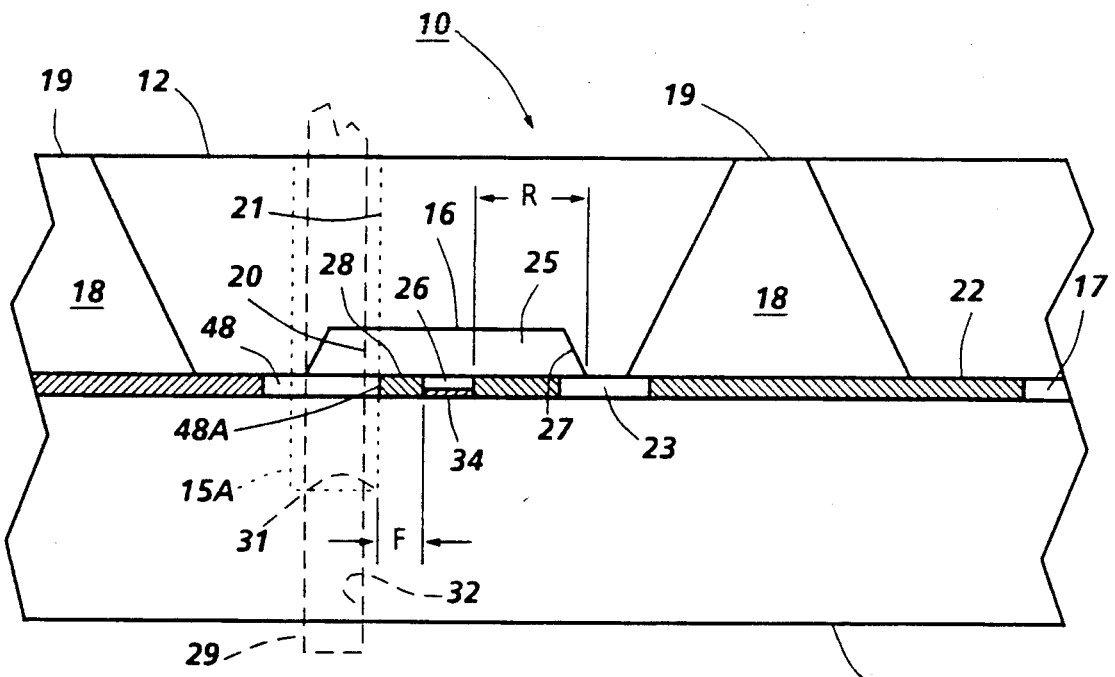
FIG. 3 is a cross-sectional of a portion of aligned and bonded channel and heating element wafers prior to separation into individual printheads according to the present invention.

Thermal ink jet printheads suitable for commercialization have fixed values of front and rear channel portion lengths as shown in FIG. 3, the front channel portion 28, having the distance F, of the present invention has its thick film layer 22 photodelineated, so that the nozzle face cutting by a resinoid dicing blade (not shown) does not involve dicing the thick film layer. This provides two chief benefits, viz., there are no burrs generated and the dicing blade life is longer.

Figure 5:
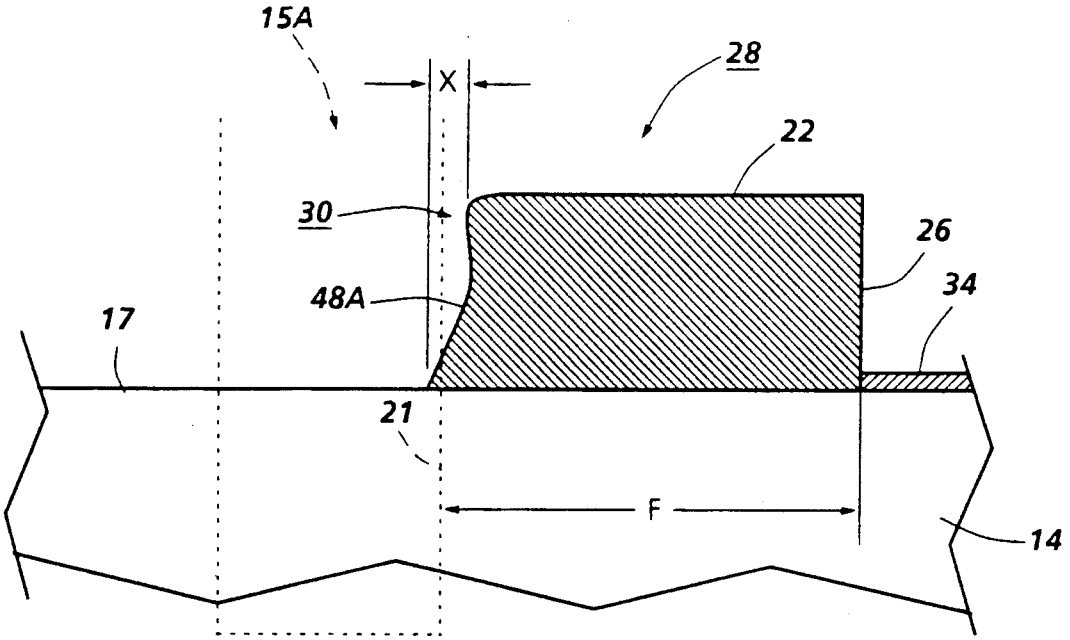
FIG. 5 is an enlarged cross-sectional view of the thick film layer between the channel and heating elements wafers showing the photodelineated thick film layer and the nozzle face dicing cut of the present invention.

Referring to FIGS. 3 and 5, cross-sectional views of the present invention, portions of an electrically insulative planar substrate, such as, for example, a silicon wafer 14 and anisotropically etched (100) silicon wafer 12 are shown aligned and bonded together with a patterned thick film layer 22 sandwiched therebetween. The silicon wafer 14 is also referred to as a heater wafer because it contains the heating elements. An electrically insulating layer (not shown) is deposited at least on surface 17 of the silicon wafer 14, such as, for example, silicon dioxide, prior to forming the plurality of linear arrays of heating elements 34 and associated addressing electrodes thereon. The heating elements are selectively addressable with electrical pulses through the addressing electrodes which are representative of digitized data signals. A thick film layer 22 of a photopatternable polymeric material, such as, polyimide, Vacrel ®, or Riston ® is deposited over heater wafer surface 17 and the heating elements and addressing electrodes thereon. The thick film layer, preferably polyimide, is patterned for etch removal of the thick film layer at predetermined locations; viz., over the heating elements to place them in pits 26 and electrode terminals (not shown), elongated recess 23 which subsequently functions as an ink passageway between the manifold or reservoir through recess 18 and the channel grooves 16, and slots 48 having at least one sidewall 48A parallel to and spaced a predetermined distance from the pits, so that portions of this slot sidewall becomes the base portion of the nozzles 20. The silicon wafer 12, also referred to as a channel wafer, is patterned and anisotropically etched to form a plurality of sets of channel grooves 16 and one etched through recesses 18 having open bottoms 19 for each set of channel grooves. The cross-sectional view in FIG. 3 shows only a portion of the bonded wafers containing one unsevered printhead 10 for ease in understanding the invention, but if a cross-sectional view were shown of the entire wafers, several unsevered printheads would be shown. The portion of the channel wafer shown in cross section in FIG. 3 shows one of plurality of sets of channel grooves 16 and the associated through recess 18 with an open bottom 19 that serves as an ink inlet.

As described in U.S. Pat. Nos. 4,774,530 and 4,638,337 and incorporated herein by reference, the photopatternable thick film layer 22 is deposited and patterned over the heater wafer surface 17 (the insulative layer not being shown), including the arrays of heating elements and addressing electrodes, to expose the heating elements by pits 26 and electrode terminals (not shown), and to form passageway recess 23 as the means for placing each set of channel grooves into communication with their associated reservoir. In the preferred embodiment of this invention, the thick film layer is polyimide having a thickness of 10 to 100 μm, preferably about 25 μm, though other materials such as, for example, Vacrel ®, or Riston ® could be used. U.S. Pat. No. 4,878,992 relates to an improved dicing method for sectioning of the multiple printhead containing channel and heater wafers into separate printheads and this patent is also incorporated herein by reference. Unfortunately, burrs of the thick film layer (i.e., the polyimide layer) were sometimes generated at the nozzles by the dicing and fabricating procedure of U.S. Pat. No. 4,878,992. This invention solved that problem by patterning the slot 48 in the thick film layer to photodelineate the front channel length "F" of the front channel portion 28, so that the polyimide layer 22 is substantially not touched by the dicing blade (not shown) as the nozzle face 21 having nozzles 20 therein is produced by the kerf 15A. As in U.S. Pat. No. 4,878,992 a second dicing operation completes the sectioning of the bonded wafers into individual printheads. In FIG. 3, the second dicing blade 29 is shown in dashed line.

Referring to FIG. 5, the photo-delineated front channel portion 28 will have a rounded corner edge 30 with a 2 to 6 μm generally sloping surface from the top edge of the thick film layer to the heater wafer surface 17 as indicated by dimension "X". Thus, when the kerf 15A, shown in dashed line, is made to open the channel grooves 16, producing the nozzles 20 and nozzle face 21, the polyimide forming the base of the triangular channel, is very smooth, uniform, and without burrs. Also, because the dicing blade makes minimal contact with the polyimide thick film layer, blade wear is due entirely to silicon, so that blade life is greatly increased.

Figure 4:
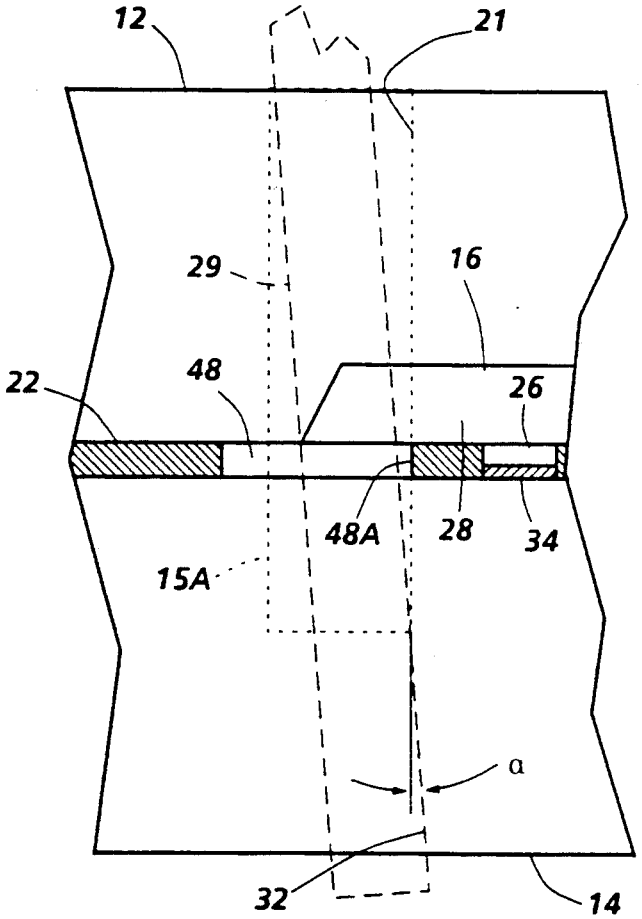
FIG. 4 is similar to FIG. 3, but showing an alternate method of severing the printheads.

A small step or shelf 31, shown in dashed line, is produced by the second dicing cut having a width of 20 to 30 μm. This step is made as the printheads are separated from the mated wafers by dicing blade 29 shown in dashed line in FIG. 3. This step is necessary to keep dicing blade 29 from contacting the nozzle face 21. However, this step 31 may be eliminated, if the second dicing cut that separates the bonded wafers into individual printheads is made at a slight angle α of 1 to 10 degrees as shown in FIG. 4. Thus, the front surface portion 32 of the printheads below the heating elements on the heater wafer produced by dicing blade 29 will also have an inward sloping wall 32A of α degrees relative to the nozzle face 21.

The thermal ink jet die or printheads of the present invention are generated in batches by aligning and adhesively bonding an anisotropically etched channel wafer to a heater wafer with a patterned polyimide thick film layer thereover, so that it is sandwiched between the wafers, followed by a dicing procedure to separate the individual printheads. The rear channel portion 25 of channel grooves 16, having length "R", of 100 to 200 μm and preferably 150 μm, are determined by the placement of rear, closed ends 27 of the channel grooves 16 relative to the removed portion 23 of the thick film layer, which will serve as an ink passage from the reservoir recess 18 to the channel grooves, during the aligning and bonding step. The front channel portion 28 of the channel grooves 16 having length "F" of 90 to 130 μm and preferably about 120 μm, are determined by the photodelineation of the thick film layer during the patterning thereof, followed by the dicing operation which opens the front, closed end of the channels to produce concurrently the nozzles 20 and the relatively smooth nozzles face 21. This dicing cut which produces kerf 15A substantially does not touch the thick film layer as it cuts through channel wafer 12 and about half way through the heater wafer.

Figure 6:
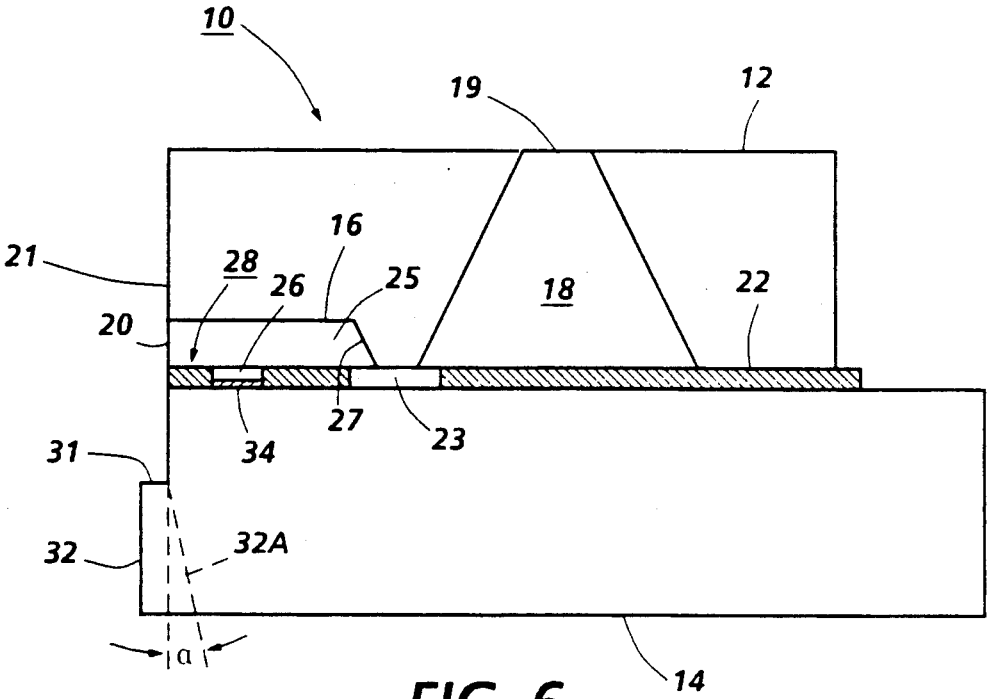
FIG. 6 is a cross-sectional view of the printhead of the present invention after separation into individual printheads.

A completed printhead 10, one of several obtained when the mated channel wafer and heater wafer are processed according to the present invention and diced into separate printheads, is shown in FIG. 6. The nozzle face 21 is produced by a resinoid dicing blade (not shown) that severs the channel wafer 12 and notches the heater wafer 14 to a depth of about half the thickness of the heater wafer or about 10 mils. One important difference over the prior art is that the thick film layer 22 is photodelineated to produce a front channel portion 28 by a slot 48, so that the front channel length F is fixed between the heating element pits 26 and the slot sidewall 48A providing a relatively smooth slightly sloping surface with a rounded corner 30 that defines the location of the nozzles and the nozzle face. Kerf 15A (see FIG. 3) to be produced by the resinoid dicing blade is located adjacent the slot sidewall 48A so that the thick film layer is not cut by the nozzle and nozzle face producing dicing operation and burrs of thick film layer are avoided. Since this dicing operation does not cut thick film layer material, the dicing blade life is increased and the yield is nearly 100% because of the absence of burrs of thick film material.

The second dicing operation completes the separation of printheads but the dicing blade 29, generally a coarse-cutting, metal dicing blade, must be spaced from the smooth nozzle face 21 so that it is not scarred or damaged. This second dicing cut is made in about the center of the nozzle and nozzle face producing kerf 15A, so that a step 31 is produced having a width measured from the nozzle face of 20 to 30 mils. The remainder of the printhead face produced by the second dicing cut is a rather rough surface wall 32. Optionally, this step 31 may be substantially eliminated by adjusting the dicing blade 29 to an angle α, then this part of the printhead front edge will form a sloping wall 32A at the same angle as that of the blade. The sloping wall is shown in dashed line in FIG. 6. However, in the preferred embodiment, the step 31 is retained because it is too far removed from the nozzle to collect ink that will affect droplet directionality.

Figure 7:
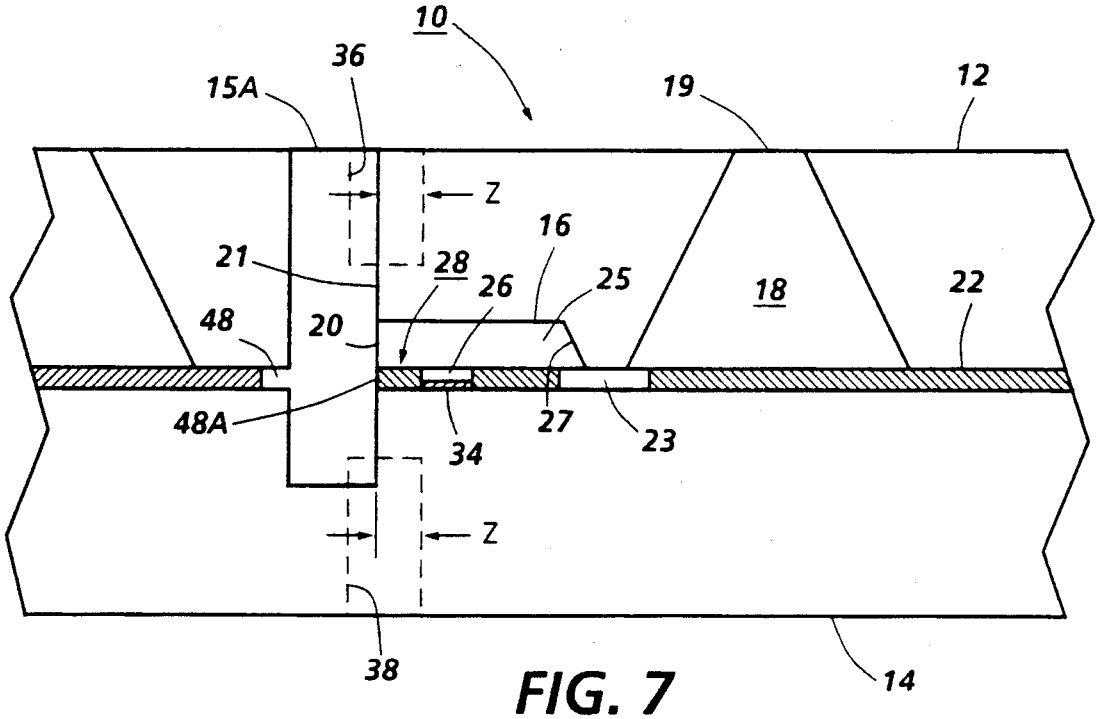
FIG. 7 is a cross-sectional view of an alternate fabricating embodiment of the invention.
Figure 8:
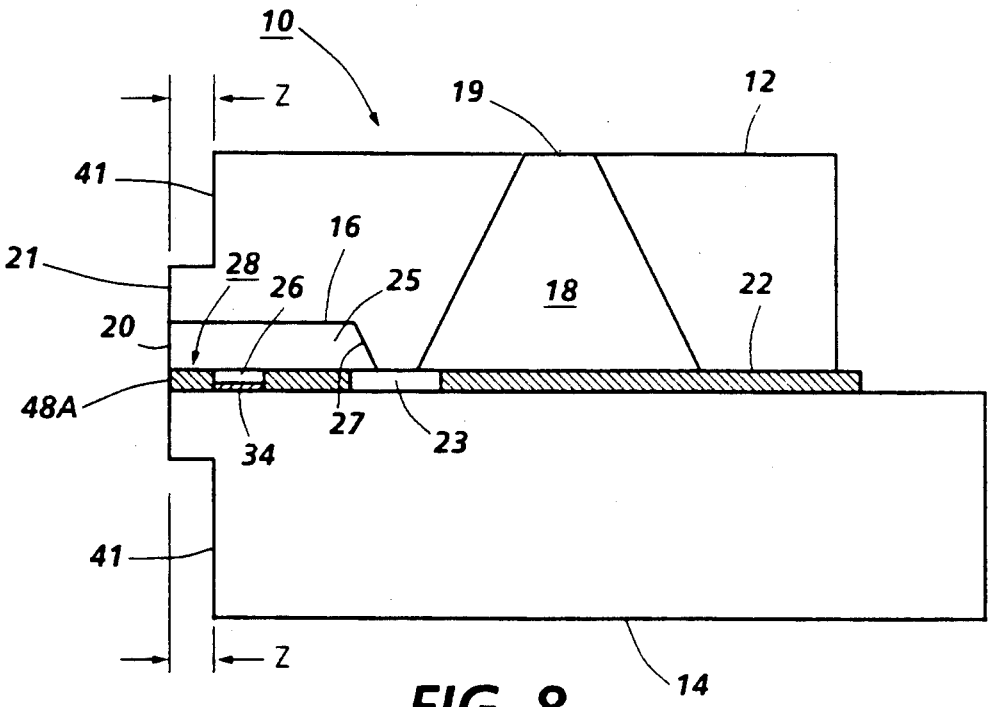
FIG. 8 is a cross-sectional view of the printhead according to the fabricating method shown in FIG. 7.

Another embodiment of the invention is shown in FIGS. 7 and 8. In this embodiment, instead of using a single second dicing cut to complete the severing of the mated channel and heater wafers into separate printheads, two kerfs 36 and 38 are used, shown in dashed line in FIG. 7, having a kerf wall spaced inwardly from the nozzle face 21 by the distance "Z" of between 0 and 50 μm. The kerf 36 is made immediately after completion of kerf 15A, but kerf 38 must be made after the mated wafers with kerfs 15A and 36 are removed from the dicing frame (not shown) and installed in another dicing frame (not shown) upside down, so that the heater wafer is exposed and the diced channel wafer is adhesively held in the new dicing frame. Kerf 38 is then produced in the heater wafer at a location spaced inwardly from the nozzle face 21 by the distance Z of 0 to 50 μm. The embodiment of FIG. 7 produces a printhead having a nozzle face 21 which may protrude up to 50 μm from the rest of the printhead front face 41 or it may be substantially coplanar. Such a printhead front face as shown in FIGS. 8 and 9 may be positioned closer to the recording medium than that of FIGS. 6, because of the step 31 thereof.

Figure 9:
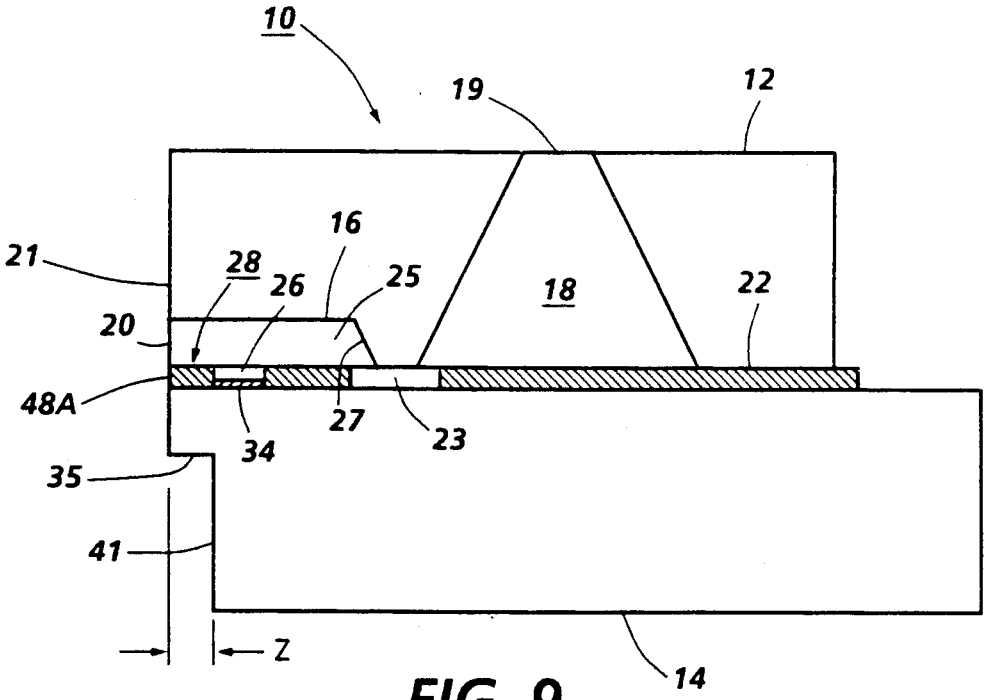
FIG. 9 is a cross-sectional view of another embodiment of a printhead fabrication by the method disclosed in FIG. 7.

In yet another embodiment, the kerf 36 in FIG. 7 is omitted and the printhead of FIG. 9 is produced wherein the step 35, if produced, is underneath the nozzles 20 and cannot collect ink.

The thick film or polyimide burr defect discussed earlier is caused by using a dicing blade to cut the thick film layer. Although it is possible to cut thick film layers cleanly, such as polyimide, it is difficult to achieve consistently. Typically, a 2–3 μm burr remains after a dicing cut at the base of the channel. The burrs have some effect on ink droplet directionality. By photodelineating the polyimide thick film layer to the correct front channel portion length, only the bottom tail of the sloped sidewall 48A, if any, is cut (refer to FIG. 5), and it has been demonstrated that no burrs result.

In summary, this invention relates to an improved thermal ink jet printhead and improved method of making it. The method comprises forming a plurality of arrays of heating elements and addressing electrodes therefor on one surface of a silicon wafer or substrate and depositing and photopatterning a thick film layer of polyimide or other photopatternable material, so that the heating elements and electrode terminals are exposed. In one embodiment, a recess is patterned in thick film layer for each array of heating elements for subsequent use as an ink passageway, as is well known in the art. An elongated slot is also formed in the thick film layer a predetermined distance from the heating elements and parallel thereto. This predetermined distance defines the distance from the nozzles to the heating elements and provides the means for photodelineation of the thick film layer so that, after bonding an anisotropically etched channel wafer thereto, the bonded pair of wafers may be diced into a plurality of individual printheads without the need to dice the thick film layer. This means that burrs of thick film material will not be formed in the nozzle and dicing blade life is greatly increased. The channel wafer is patterned and anisotropically etched to produce a plurality of sets of elongated channel grooves, closed at both ends, and a through recess for each set of channel grooves which will subsequently serve as a reservoir, whose open bottom will serve as an ink inlet.

The anisotropically etched channel wafer is aligned and bonded to the patterned thick film layer, so that a heating element in an etched thick film pit is located in each channel groove of the channel wafer. A resinoid dicing blade severs the channel wafer opening one end of the channel grooves and producing the nozzles and nozzle face and concurrently notching the heater wafer to a depth of about half the heater wafer thickness. A second more coarse dicing blade separates the two wafers into individual printheads. Since the nozzle and nozzle face producing dicing cut substantially does not cut the thick film layer, burrs are not produced which reduce yield and the resinoid dicing blade life is greatly increased.

Many modifications and variations are apparent from the foregoing description of the invention, and all such modifications and variations are intended to be within the scope of the present invention.

I claim:

1. An improved ink jet printhead of the type having a linear array of droplet ejecting nozzles and a silicon upper substrate in which one surface thereof is anisotropically etched to form both a set of parallel grooves for subsequent use as ink channels and an anisotropically etched recess for subsequent use as a manifold, and further having a lower substrate in which one surface thereof has an array of heating elements and addressing electrodes formed thereon, the upper and lower substrates being aligned, mated, and bonded together to form the printhead with a thick film insulative layer sandwiched therebetween, the thick film insulative layer having been deposited on the surface of the lower substrate and over the heating elements and addressing electrodes and patterned to form recesses therethrough to expose the heating elements and terminal ends of the addressing electrodes prior to said mating and bonding of the substrates, wherein the improvement comprises:

(a) an elongated slot being formed in the thick film layer on the lower substrate concurrently with the heating elements and electrode terminal exposing recesses and at a location which is parallel to the heating elements array and spaced therefrom a predetermined distance, the slot having parallel sidewalls with the sidewall nearer the heating elements subsequently becoming a portion of the printhead nozzles;

(b) said upper and lower substrates being aligned and mated so that the upper substrate is aligned with the slot in the thick film layer on the lower substrate forming said ink channels and manifold with one of the closed ends of the grooves extending perpendicularly beyond the slot in the thick film layer film sidewall nearer the heating elements;

(c) said etched channel grooves in the upper substrate each being opened at the ends opposite the ones adjacent the manifold recess to produce portions of said nozzles after mating with the lower substrate by dicing a kerf with a resinoid dicing blade that perpendicularly intersects the grooves and forms a trench of predetermined depth having parallel sidewalls, so that only one of the trench sidewalls intersect the grooves to define a subsequent portion of a nozzle face for the printheads containing the groove open ends which form a portion of the printhead nozzles, the other ends of the grooves being placed into communication with the manifold recess, the kerf severing the upper substrate and notching the lower substrate without having to dice the thick film layer, thus avoiding yield reducing burrs and increasing the resinoid dicing blade lifetime; and (d) a stepped nozzle face is formed by dicing along a plane parallel to and through the kerf to separate the bonded substrates into individual printheads without contacting the nozzle face.

2. The printhead of claim 1, wherein the stepped nozzle face is modified so that the portion containing the nozzles is raised while the remainder of the nozzle face is recessed by dicing the bonded substrates by two separate dicing cuts which intersect the kerf a predetermined distance toward said heating element and each of the two separate cuts having a predetermined depth of cut.

3. A method of fabricating a thermal ink jet printhead having nozzles for ejecting droplets therefrom comprising the steps of:

(a) forming a plurality of sets of equally spaced linear arrays of heating elements and addressing electrodes on the surface of an electrically insulative planar substrate, the heating elements being individually addressable with electrical pulses through said electrodes;

(b) depositing a thick film layer of photopatternable polymeric material over the heating elements and electrodes;

(c) photopatterning the thick film layer to form a plurality of pits therein, each of which exposes one of the heating elements and to form an associated slot for each set of pits, the associated slot having at least one side wall which is parallel to the heating element arrays and defines the distance between the heating elements and the nozzles, the photodelineated slot sidewall subsequently becoming a part of the printhead nozzles;

(d) etching a plurality of sets of equally spaced, parallel channel grooves having closed ends and an associated through recess for each set of channel grooves in the surface of a silicon wafer, the through recesses being located adjacent one end of said grooves;

(e) providing means for communication between each set of grooves and their associated through recess;

(f) aligning and bonding the etched wafer with the planar substrate so that each set of channel grooves contain a heating element therein a determined distance from the channel groove closed ends opposite the ones adjacent the associated through recess;

(g) dicing a kerf having a predetermined depth perpendicular to and across each of the groove ends opposite the ones adjacent the through recesses to form a nozzle face containing the groove open ends that will subsequently become part of the printheads nozzles, the depth of the kerf extending into the insulative planar substrate closely adjacent the slot sidewall produced in the thick film layer, so that minimal contact with the thick film layer occurs, thus avoiding the production of burrs; and (h) separating the bonded wafer and substrate into individual printheads by a plurality of dicing cuts, one of which includes colinear dicing of the wafer and substrate along and through the kerf, but spaced from the nozzle face.

4. The fabricating method of claim 3, wherein said means for providing communication between each set of grooves and their associated recess in step (e) is accomplished prior to step (f) by dicing a trench of predetermined depth perpendicular to the sets of channel grooves and in between said channel grooves and associated through recess, thereby removing the silicon wafer material therebetween.

5. The fabricating method of claim 3, wherein said means for providing communication between each set of grooves and their associated recess is accomplished during step (c) by additionally patterning an elongated recess in the thick film layer which will provide an ink flow passageway between the set of grooves and its associated through recess after the wafer and planar substrate are mated during step (f).

6. The fabricating method of claim 4, wherein the planar substrate containing the heating elements is a silicon wafer; and wherein the thick film layer is polyimide.

7. The fabricating method of claim 5, wherein the planar substrate containing the heating elements is a silicon wafer; and wherein the thick film layer is polyimide.

8. The fabricating method of claim 7, wherein the separation of the bonded wafers in step (h) is accomplished with a dicing blade rotated a predetermined amount about the intersection of the bottom of the kerf and the kerf wall containing the nozzle face, so that no step is produced by the dicing separating cut while concurrently keeping said dicing blade spaced from the nozzle face.

9. The fabricating method of claim 7, wherein the separation of the bonded wafers in step (h) is accomplished by two separate dicing cuts which produce second and third kerfs on opposite sides of the bonded wafers which intersect the first kerf produced during step (g) to provide printheads with a nozzle face which protrudes from the rest of the printhead surface containing the nozzle face.

10. The fabricating method of claim 7, wherein the separation of the bonded wafers in step (h) is accomplished by dicing a second kerf of predetermined depth in the wafer opposite the one containing the kerf therethrough, said second kerf intersecting the bottom of the first kerf, whereby the second kerf produces a step of 0 to 50 $\mu$m with said nozzle face.

* * * * *